US008911252B2

(12) United States Patent
Sittenauer

(10) Patent No.: US 8,911,252 B2
(45) Date of Patent: Dec. 16, 2014

(54) ELECTRICAL APPARATUS, IN PARTICULAR FOR RECEIVING SIGNALS OR OUTPUTTING SIGNALS

(71) Applicant: Robert Bosch GmbH, Stuttgart (DE)

(72) Inventor: Stefan Sittenauer, Garmisch-Partenkirchen (DE)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 13/716,361

(22) Filed: Dec. 17, 2012

(65) Prior Publication Data

US 2013/0157502 A1 Jun. 20, 2013

(30) Foreign Application Priority Data

Dec. 15, 2011 (DE) ..... 10 2011 088 661

(51) Int. Cl.
*H01R 13/625* (2006.01)
*G08B 17/10* (2006.01)

(52) U.S. Cl.
CPC ..... *H01R 13/625* (2013.01); *G08B 17/10* (2013.01)
USPC ..... 439/332

(58) Field of Classification Search
USPC ..... 439/332, 334, 337
See application file for complete search history.

(56) References Cited

U.S. PATENT DOCUMENTS

| | | | | |
|---|---|---|---|---|
| 3,363,217 | A * | 1/1968 | Garver et al. | 439/337 |
| 4,074,341 | A * | 2/1978 | Niederost et al. | 361/600 |
| 4,139,770 | A * | 2/1979 | Beyersdorf | 250/381 |
| 4,238,679 | A | 12/1980 | Macmillan et al. | |
| 4,245,878 | A * | 1/1981 | Hall | 439/332 |
| 4,952,157 | A * | 8/1990 | Hudson et al. | 439/92 |
| 6,634,901 | B2 * | 10/2003 | Kerr, Jr. | 439/333 |
| 6,780,049 | B1 * | 8/2004 | D'Angelo et al. | 439/537 |
| 2004/0048507 | A1 * | 3/2004 | Hage | 439/332 |
| 2005/0266716 | A1 * | 12/2005 | Hoxha | 439/332 |
| 2009/0258524 | A1 * | 10/2009 | McEnery | 439/334 |
| 2010/0273343 | A1 * | 10/2010 | Ai | 439/332 |
| 2010/0277018 | A1 * | 11/2010 | Arnould et al. | 310/71 |
| 2011/0173708 | A1 * | 7/2011 | Combs et al. | 800/3 |

FOREIGN PATENT DOCUMENTS

| | | |
|---|---|---|
| DE | 19808872 | 9/1999 |
| EP | 1376504 | 1/2004 |
| GB | 2426323 | 11/2006 |

* cited by examiner

*Primary Examiner* — Gary Paumen

(74) *Attorney, Agent, or Firm* — Michael Best & Friedrich LLP

(57) ABSTRACT

An electrical apparatus (1) comprising a base (2) for being attached to a substrate (4), a functional head (3) which has at least one electrical or electronic functional device (10), wherein the functional head (3) is attached to the base (2) with a bayonet connection (6), wherein the base (2) has a first contact (14) and the functional head (3) has a second contact (30), which are contact-connected to one another, wherein the bayonet connection (6) can be formed by a relative movement of the functional head (3) in relation to the base (2) in an axial direction (A), and a subsequent relative rotation, and the first contact (14) and second contact (30) can be contact-connected to one another by the relative rotation.

19 Claims, 6 Drawing Sheets

ELECTRICAL APPARATUS, IN PARTICULAR FOR RECEIVING SIGNALS OR OUTPUTTING SIGNALS

BACKGROUND OF THE INVENTION

The invention relates to an electrical apparatus which is used, in particular, for receiving signals or outputting signals. The electrical apparatus can be, in particular, a fire alarm or a signal transmitter for an optical indicator, for example for indicating an emergency exit.

Electrical apparatuses of this kind are intended to be mounted on a substrate, for example a ceiling or a side wall. The electrical apparatus points to a base which is attached to the substrate, and a functional head which is reversibly mounted on the base. The functional head can have, for example, a smoke detector for detecting smoke, in order to identify a fire. When in the form of a signal transmitter, a lamp or a lighting means, for example, is provided in the functional head.

DE 198 08 872 A1 describes an alarm of this kind. The base is used for connecting electrical lines. A bayonet connection for locking and contact-making purposes is formed between the base and the alarm head.

Alarms of this kind are sometimes fitted relatively high up, and therefore they generally cannot be replaced by a user when he is standing up. To this end, auxiliary apparatuses are sometimes used, in particular so-called "picker rods", which allow the functional head to be grasped and removed by said functional head being rotated and pulled out of the bayonet connection.

However, disadvantages or problems sometimes occur in this case. For example, when the apparatus is fitted on an uneven substrate, there may be an insufficient degree of contact reliability in the event of deformation of the alarm head. Handling by means of, for example, picker rods may lead to a relatively high force effect if not applied with an accurate fit, and this may possibly bend or damage sensitive parts. This may, in particular, also damage the electrical contacts. By forming the electrical contacts in the bayonet connection, said electrical contacts are subject to loading by the axial displacement and subsequent relative displacement, even when the bayonet connection is properly formed, if the user executes the movements with force.

In this context, a bayonet connection or a bayonet fitting is understood to be, in particular, a connection between two components in which the two components are connected by axial adjustment, in particular axial insertion one into the other, and subsequent relative rotation. During the axial adjustment, a projecting part, which can be designated a lug in general, is displaced in the axial direction in a corresponding recess; during the subsequent relative rotation of the two components, the projecting part slides in a slot which adjoins the recess (or is in the form of part of the recess) in a peripheral direction.

Bayonet connections are generally secured by clamping; to this end, systems with spring tension in the axial direction and systems with a frictional connection, for example, are known.

Furthermore, apparatuses of this kind which are fitted to a wall or ceiling are subject to shaking and vibrations which may lead to the contact-making means becoming loose and possibly to the bayonet connection becoming unlocked.

Secure bayonet connections can sometimes be formed by relatively complex designs with a relatively high number of parts used. However, this produces costly solutions having a plurality of manufacturing steps and a high degree of outlay on installation. In particular, certain mounting tolerances have to be complied with, depending on the construction, so that secure contact is ensured even when used at a relatively high level.

SUMMARY OF THE INVENTION

According to the invention, the electrical contact is made by first and second contact means, wherein a plurality of first and a plurality of second contact means are provided in accordance with the number of electrical contacts to be formed.

According to the invention, the first and second contact means are first contact-connected to one another, that is to say engage to form an electrical contact, during the relative rotation of the functional head in relation to the base. During the initial axial adjustment, there is accordingly still no electrical contact. In this case, the contact-making means can be released in a reversible manner, that is to say the contacts are released again by rotation in the opposite direction.

Within the scope of this invention, the axial direction is understood to mean the direction along the longitudinal axis or axis of symmetry which therefore also (at least substantially) defines the relative adjustment of the bayonet connection. A horizontal plane (or radial plane) is understood to mean the plane perpendicular to the axial direction, wherein the radial direction respectively runs radially outward from the axis of symmetry A in the radial plane. A peripheral direction is understood to mean the direction on an arc of a circle around the axis of symmetry; therefore, cylinder coordinates are essentially defined by these terms.

According to an advantageous development, two sliding planes are formed between the two components (base and functional head), specifically a first sliding plane in which the two components slide in a rotatable manner on one another initially with (entirely or substantially) matching axes of symmetry until they have found the encoded or defined starting position for subsequently forming the relative adjustment in the axial direction. At the end of the axial adjustment, they lie one on the other in a second sliding plane in which contact is made between the first and second contact means by the relative rotation.

The relative position for forming the subsequent bayonet connection is advantageously defined by encoding means which are formed on the two components, that is to say first and second encoding means which permit engagement only when they are in a correct and clearly defined relative position in relation to one another. The encoding means can be configured, for example, as encoding lugs and encoding recesses. According to a preferred embodiment, the encoding lugs are used to engage in the encoding recesses in order to thereby form the bayonet connection. However, it is also possible, in principle, to form the encoding means independently of the bayonet connection, so that the encoding means define only the correct relative angular position.

Since the plurality of first encoding means do not match and correspondingly the plurality of second encoding means do not match, incorrect engagement is avoided. In this case, the encoding means can have, for example, one or more slots, for example also of different widths or with different spacings.

The first sliding plane can be defined by abutment of the encoding lugs on a boundary surface, in particular housing edge of the other part; therefore, the encoding lugs slide on the boundary surface until they have found the matching encoding recesses. Even when temporarily sliding over incorrect positions, incorrect engagement and preferably also obstruction of the sliding movement by, for example, latching or hooking into said encoding recess does not take place since the encoding means are correspondingly selected. Engagement for the axial adjustment takes place only after the encoded position is reached.

The contact means selected can be, in particular, resilient first contact means and fixed second contact means. The resilient contact means can, in particular, be in the form of forked contacts with two spring tongues which receive the fixed contact means, for example a contact blade or a contact tongue which extends in the axial direction, between them. Therefore, a contact surface is in the form of a sliding surface between the contact means. Therefore, the fixed contact means enter the resilient second contact means during the contact-making relative rotation during the insertion process.

According to a further advantageous design, a resistance torque is formed when the bayonet connection is formed, said resistance torque therefore being used as a clamping means for securing the bayonet connection. This resistance torque can deviate from a resistance torque when the finished bayonet connection is released; in particular, the second resistance torque for releasing the bayonet connection can be greater than the first resistance torque. Therefore, a haptic sensation of a locking or unlocking operation is imparted to the user. The clamping and the resistance torques can be formed, in particular, by friction means on the two components, for example a resilient friction means, in particular in the form of spring pin which slides on a ramp of the other component. The ramp can be formed, for example, directly on a housing edge or a housing border of this component.

A plurality of ramp surfaces can accordingly be formed in order to form different resistance torques, for example a slightly upwardly sloping first ramp surface for forming the first resistance torque when the components are screwed in, and a steeper second ramp surface for securing the connection and for forming the second, higher resistance torque when the bayonet connection is released.

The invention provides several advantages:

Since contact is made between the first contact means and second contact means only during the relative rotation of the bayonet connection, this contact-making movement can be decoupled from the axial adjustment which takes place with a relatively great expenditure of force. Therefore, if the user pushes in the functional head in the axial direction, possibly with force or with great vigor, this does not damage the electrical contacts. They engage only during the relative rotation. Since this relative rotation is inhibited by the resistance torque which is haptically sensed by the user, excessively vigorous engagement of the contact means during the relative rotation is also prevented.

The invention therefore advantageously results in the main interference variables during contact-making no longer having an effect in the direction of the contact force.

Since the electrical contact means are separated from the bayonet connection, tolerances in particular no longer have a direct effect on the electrical contact-making operation when the bayonet connection, that is to say the lug and the recess of the bayonet connection, is formed either. Wear or mechanical loading due to multiple screwing-in and screwing-out operations, possibly with a relatively high degree of force and a slightly inclined angle of action of a picker rod may also possibly lead to slight loading, for example, of the recess running in the axial direction and the lug; however, the electrical contacts are no longer affected by this.

Since a first and second sliding plane are formed, expenditure of force by oblique application or tilting are also kept low or avoided entirely in this case. The user identifies the correct bearing position, that is to say matching of the axes of symmetry, since he can rotate the components relative to one another. Therefore, said user can subsequently further rotate said components in a deliberate manner until the encoding means come into line with one another, then carry out the axial adjustment until he reaches the second sliding plane.

According to the invention, deformation of the base and mounting and manufacturing tolerances no longer have the same direction of action as the contact force of the contact means. Since the contact means are designed as elastic contact means, in particular as forked contacts and fixed contact means, the mounting tolerance can be kept sufficiently high by appropriately dimensioning said contact means. If the fixed contact means is in the form of contact blades or contact tongues, it can have, for example, a size of several square millimeters, for example in the form of a rectangular area, and therefore mounting tolerances during production may possibly also be a few millimeters, without problems occurring in respect of the contact-making operation. Therefore, a mounting tolerance in the axial direction is not so considerable. The electrical contacts can therefore each be placed in suitable receptacles in the axial direction, for example directly into a housing of their component or a fitted contact plate.

Therefore, simple production is possible, in the case of which, for example, the contact blades (contact tongues, fixed contact means) are simply axially inserted and, in the process, make contact, for example, with a printed circuit board situated there beneath by being pressed in.

According to the invention, the encoding (accurate fitting and avoiding an incorrect contact-making operation), the actual contact-making operation and the locking torque can be functionally separated. To this end, the contact means, encoding means and locking means/friction means for forming the clamping means are advantageously structurally separated, wherein each of them can be realized by measures which are relatively simple to implement.

In principle, the individual pairs of contact means, encoding means and friction means/locking means can be selectively associated with the two components, that is to say the base or functional head, that is to say the first contact means can be resilient and the second contact means can be fixed, or vice versa, and furthermore the first encoding means provide the encoding lugs and the second encoding means provide the encoding recesses, or vice versa. The more valuable means, for example forked contacts in the form of resilient contact means, are preferably respectively formed on the functional head.

DETAILED DESCRIPTION

Figure 1:
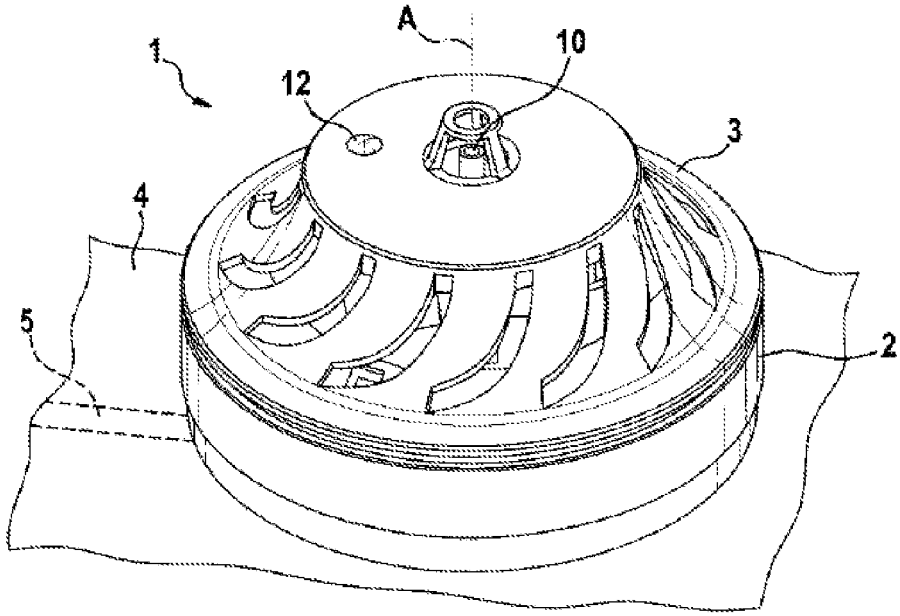
FIG. 1 shows a fire alarm as an embodiment of an apparatus according to the invention in the assembled state.
Figure 2:
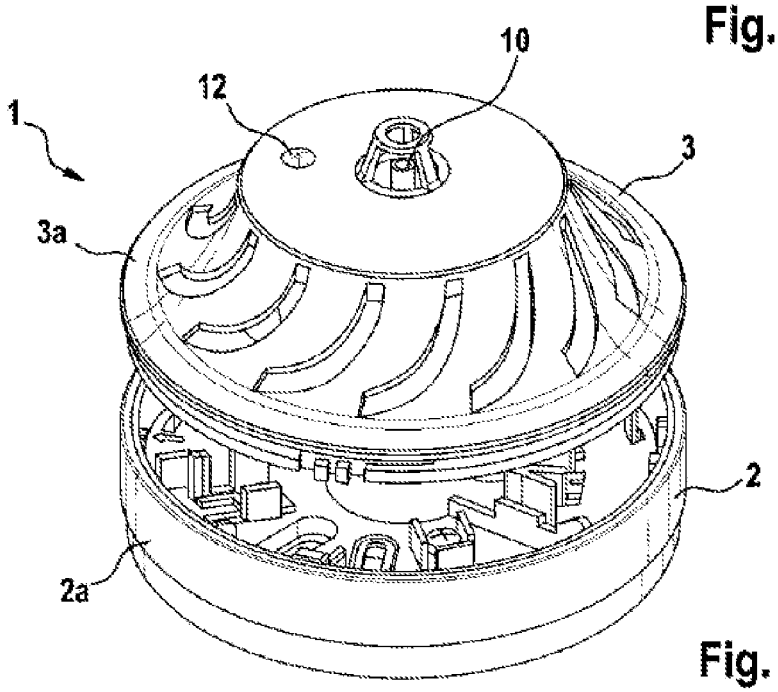
FIG. 2 shows the fire alarm from FIG. 1 before assembly.
Figure 3:
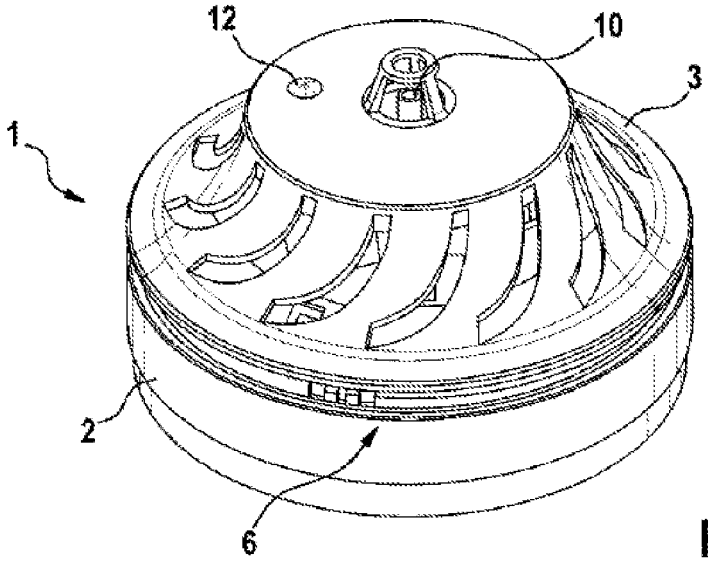
FIG. 3 shows the fire alarm with the alarm head fitted.
Figure 4:
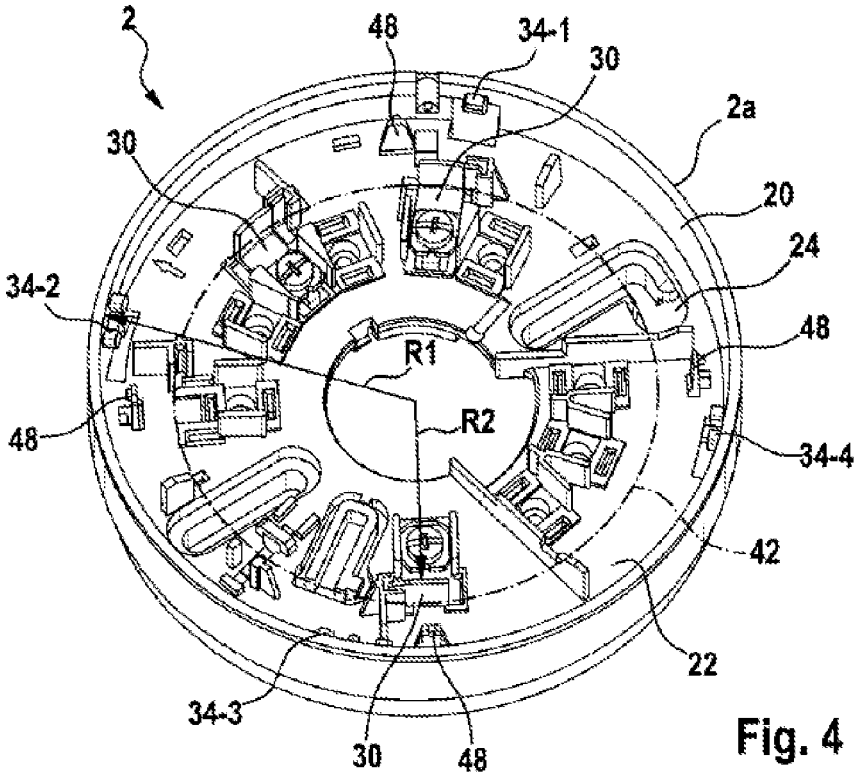
FIG. 4 shows an internal view of the base.
Figure 5:
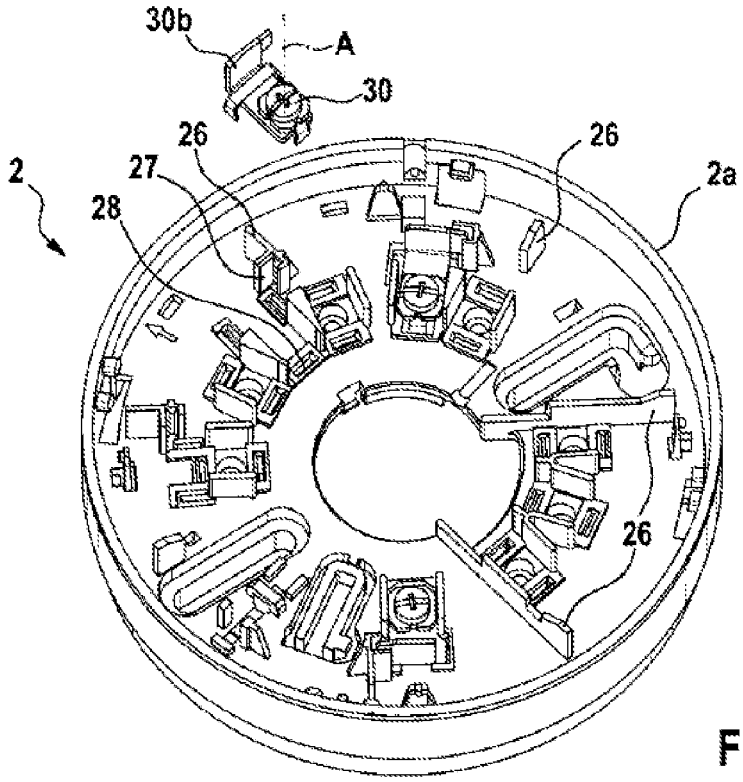
FIG. 5 shows the base before a contact blade is inserted.

FIG. 1 shows a fire alarm 1 as an example of an electrical (or electronic) apparatus according to the invention. According to FIGS. 1, 2 and 3, the fire alarm 1 has a base 2 and an alarm head 3 which is attached to the base 2. The base 2 is intended to be fitted to a substrate 4—merely indicated in FIG. 1—for example a ceiling or else a (vertical) wall; FIG. 1 accordingly shows a perspective bottom view of a fire alarm 1 which is fitted to a ceiling 4. Contact is made with the fire alarm 1 by means of an external line 5 which is, for example, of three-core or five-core design, that is to say is formed with three or five individual cables for supplying electrical power and transmitting signals, depending on the exact function of the fire alarm 1. In embodiments other than the fire alarm shown in FIG. 1, the external electrical line 5 can correspondingly be used for other or further functions. By way of example, several fire alarms 1 can also be connected to a common electrical line 5. The installation height of the fire alarm 1 on the ceiling 4 can be, in particular, a height of above 3 m, and therefore removal is generally not performed by a user by hand when he is standing up but rather is performed with the aid of a suitable handling apparatus or fitting apparatus, for example an attachment on a rod (so-called "picker rod").

FIG. 1 shows an axis A of symmetry; "axial direction" is understood to mean a direction along or parallel to the axis A of symmetry, a horizontal plane (radial plane) is understood to mean a plane which is perpendicular to the axis A of symmetry, a radial direction is understood to mean a direction in the horizontal plane which points radially outward from the axis A of symmetry, and a peripheral direction is understood to mean a direction in the horizontal plane on an arc of a circle about the axis of symmetry.

The alarm head 3 has a head housing 3*a* which is manufactured, for example, as an injection-molded part which is composed of plastic, and also has a contact plate 8 which is inserted into the head housing 3*a*, and also a smoke detector 10 (smoke sensor, fire sensor) which in this case projects downward (away from the substrate 4) at an opening in the head housing 3*a* and detects smoke or other signs of a fire in a measurement method which is known per se. The alarm head 3 also has a signaling lamp 12, for example an LED, which is exposed or protrudes in a cutout or a hole of the head housing 3*a* and, for example, is used to indicate an operating state ("on, off") and/or to signal a fire. Direct or indirect contact is made with the smoke detector 10 and the signaling lamp 12 by a printed circuit board 9 which is arranged above the contact plate 8 and is used as a circuit mount. The contact plate 8 can be in the form of a pressed part or an injection-molded part, for example.

Figure 6:
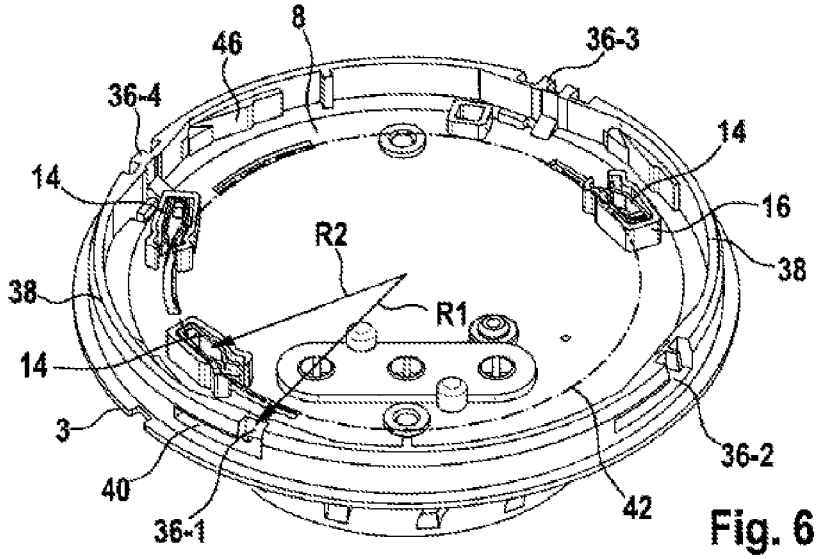
FIG. 6 shows an internal view of the alarm head.
Figure 7:
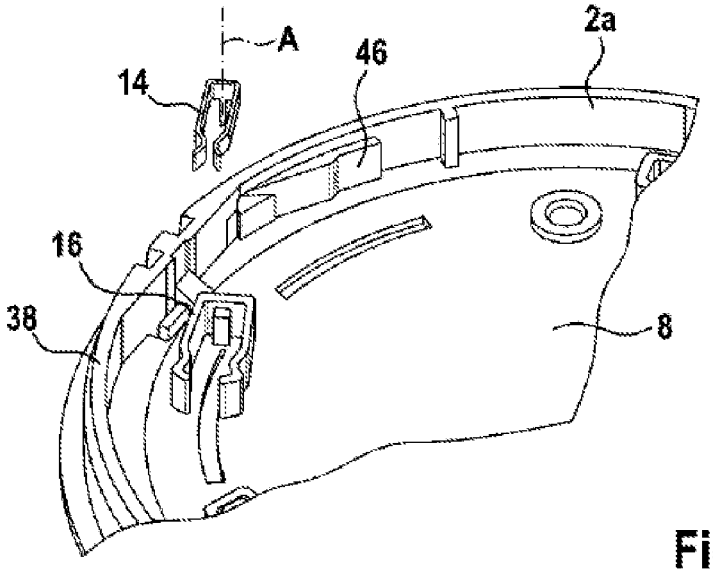
FIG. 7 shows a detail from FIG. 6 before a cable contact is inserted.
Figure 8:
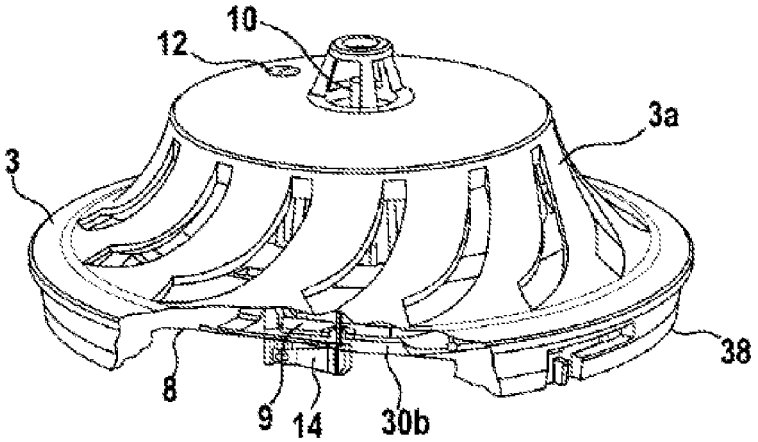
FIG. 8 shows a partially broken-away illustration of the alarm head in a view from the outside (bottom view)

A plurality of, in this case three, forked contacts 14 are accommodated on the lower face of the contact plate 8 of the alarm head 3 shown in FIGS. 6 and 7. As can be seen in FIG. 7 for example, the individual forked contacts 14 are inserted into contact receptacles (forked contact receptacles) 16 in the axial direction (along the axis of symmetry), therefore from below (accordingly shown from above in the bottom view of FIGS. 6 and 7), said contact receptacles being, for example, integrally formed with the contact plate 8.

Figure 9:
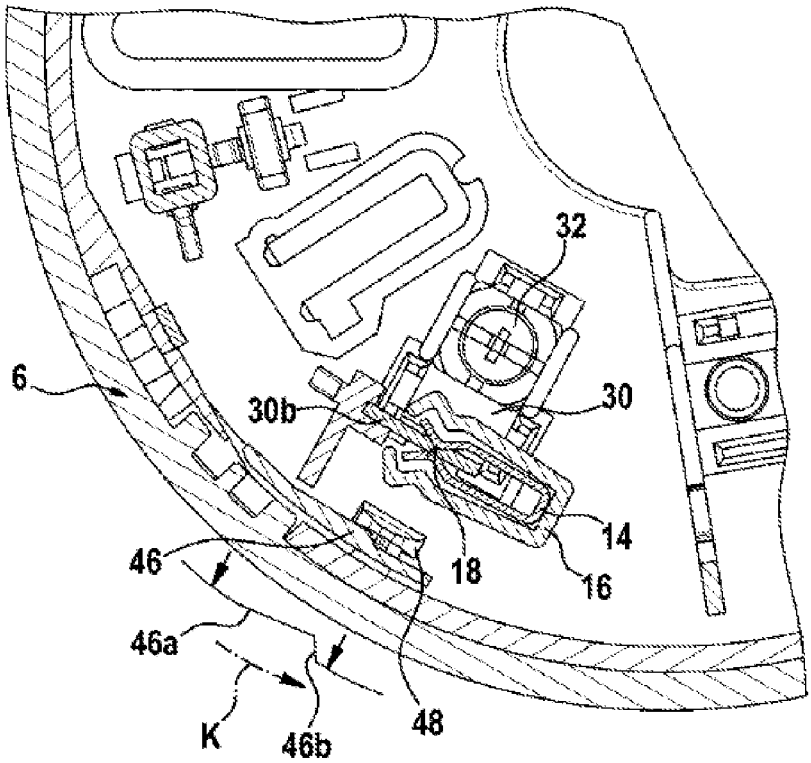
FIG. 9 shows an illustration of the mechanical connection and the electrical contact-making means between the alarm head and base.
Figure 10:
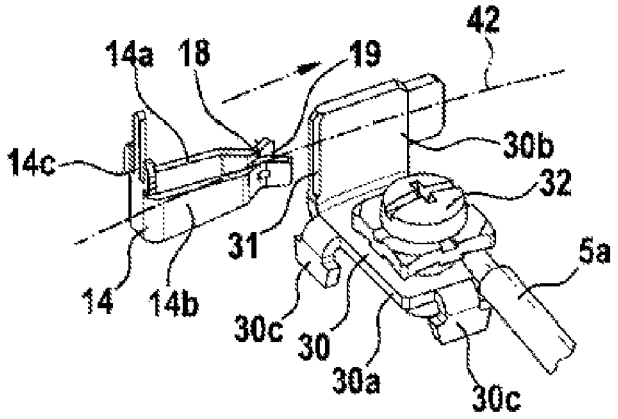
FIGS. 10 and 11 show the process of engagement of the contacts.

The forked contacts 14 each have two spring limbs 14*a*, 14*b* and a pin 14*c*, as also shown in FIG. 7 and FIG. 10 in particular. The spring limbs 14*a*, 14*b* and the pin 14*c* can be of one-piece design as a metal part or else of multipartite design and be placed, caulked, welded or soldered one into the other. The pin 14*c* projects upward (downward in FIG. 7) through the contact plate 8 and contact is made with said pin on the printed circuit board 9, for example as a press-in connection. The pin 14*c* is therefore used for the forked contact 14 to be mechanically received and electrically contact-connected. The spring limbs 14*a*, 14*b* are resiliently flexible in the plane of the contact plate 8, that is to say they can be pushed apart. The contact receptacle 16 is in each case used, as shown in the illustration of FIG. 9 in particular, to limit the spring travel of the spring limbs 14*a*, 14*b* and is therefore designed, for example, with a corresponding shaping of the spring limbs 14*a*, 14*b* and at a corresponding distance from said spring limbs in order to allow uniform contact if said spring limbs move far apart from one another. The spring limbs 14*a*, 14*b* also each have a contact surface (sliding surface) 18, wherein the contact surfaces 18 of the two spring limbs 14*a*, 14*b* are formed on the inner or facing surfaces, preferably in the region of the shortest distance between the two spring limbs 14*a*, 14*b*. In the basic state or in the inoperative state of the spring limbs 14*a*, 14*b*, that is to say without contact being made, the contact surfaces 18 can touch or else be spaced apart from one another to a certain extent. At their end which is averted from the pin 14*c*, the spring limbs 14*a*, 14*b* move away from one another again in order to form an inlet opening 19 which is therefore used for reception in a centering manner.

The base 2 has a base housing 2*a* which is, for example, integrally formed as an injection-molded part. The base housing 2*a* has a cylindrical base boundary 20 and a bottom 22, and furthermore, for example, attachment receptacles (holes, slots) 24 in the bottom 22, it being possible for, for example, screws to be placed through said attachment receptacles in order to attach the base 2 to the substrate 4, and also protective ribs 26 for protecting against improper mounting, said protective ribs extending from the bottom 22 in the axial direction and, for example, running radially, and also furthermore supporting ribs 27 and also receiving pockets (receiving cavities) 28 for receiving metal base contacts 30. The shaping of the entire base housing 2*a* together with the base boundary 20, bottom 22, attachment receptacles (holes, clearances) 24, protective ribs 26, supporting ribs 27 and receiving pockets 28 is advantageously selected in such a way that the base housing 2*a* is in the form of an injection-molded part; to this end, the base boundary 20, the ribs 26, 27 and the receiving pockets 28 project away from the bottom 22 in the axial direction, which also represents the injection-molding direction. More complex design features, for example undercuts, are, in principle, not required in accordance with this embodiment.

The base contacts 30 can, for example, be substantially angled with an abutment limb 30*a* and with lugs 30*c* which are placed in a receiving pocket 28 and are attached to the base by means of, for example, screws 32, and, as further limbs, a contact blade 30*b* which protrudes in the axial direction from the abutment limb 30*a* and is used for making contact with a forked contact 14 of the alarm head 3. The forked contacts 14 and the base contacts 30 are both produced from steel and are therefore sufficiently strong and, for example, do not exhibit problems in respect of mutual contact corrosion. The contact blades 30*b* (contact tongues) are made, for example, of steel with a thickness of 1 mm, for example with the dimensions 8 mm×8 mm. They preferably have bevels 31 at their respective edge which is at the front in the rotation direction, for making it easier to insert the forked contacts 14 into the inlet opening 19. The base contacts 30 can be formed, for example, from a steel plate by being stamped out and bent, wherein a hole for inserting the screws 32 is provided in the abutment limb 30*a*. FIG. 10 shows a cable 5*a* of the electrical line 5, said cable being stripped of insulation and being attached to the base contact 30, for example by means of being clamped in by the screws 32.

The protective ribs 26 on the bottom 22 are also used, in particular, to mechanically protect the contact blades 30*b* in the event of improper attempts to attach the alarm head 3 to the base 2; in the event of such attempts, the edge of the head housing 3*a* of the alarm head 3 can, for example, enter the interior of the base housing 2*a* and, in the process, may be caught by the protective ribs 26 and the supporting ribs 27 which support the protective ribs 26. The supporting ribs 27 branch off, for example, at a right angle from the supporting ribs 26 in order to thereby allow a stiffer kink-resistant design.

Furthermore, encoding lugs 34-i, where i=1, 2, 3, 4, are formed on the base housing 2*a*, said encoding lugs defining a relative angular position (relative position) of the alarm head 3 in relation to the base 2 and engaging in encoding recesses 36-i, where i=1, 2, 3, 4, which are formed in a substantially cylindrical boundary edge 38 of the head housing 3*a*. To this end, the encoding lugs 34 are provided in corresponding angular positions to the encoding recess 36 and at the same radial distance R1 from the axis A of symmetry. Therefore, the number and the angular position, and also the dimensioning, match; the width (in the radial direction) and length (in the peripheral direction) of the encoding lugs 34 is preferably somewhat smaller than that of the encoding recesses 36. The encoding lugs 34 and the encoding recesses 36 allow a bayonet-type engagement in this case, wherein the encoding recesses 36 extend further downward in the axial direction A to a peripheral slot 40 which runs in the peripheral direction; therefore, a bayonet-type engagement can take place, in which the encoding lugs 34 can first slide on the boundary edge 38 in an upper plane (first sliding plane) until they enter the encoding recesses 36 in the correct angular position, and can then slide in the axial direction A, that is to say downward in FIG. 6, into the encoding recesses 36 and reach the peripheral slot 40 for the first time; the peripheral slots 40 therefore define a lower plane (lower sliding plane) in which the encoding lugs 34 subsequently slide by relative rotation of the alarm head 3 in relation to the base.

Accordingly, the forked contacts 14 and the contact blades 30*b* are provided at the same second radius R2 in each case. In principle, designs are possible in which in each case only the contact pair comprising in each case a forked contact 14 and the corresponding contact blade 30*b*, which is provided for making contact with said forked contact, have the same second radius R2. However, according to the shown advantageous designs, all the forked contacts 14 and contact blades 30*b* are on the same second radius R2, that is to say a contact-making ring 42 which is shown using a dashed line in FIG. 6. The encoding recesses 36-1, 36-2, 36-3 and 36-4 are designed differently to one another; accordingly, the encoding lugs 34-1, 34-2, 34-2 and 34-4 are also designed differently, and therefore exact assignment of each encoding lug 34-i to the encoding recess 36-i is defined for i=1, 2, 3, 4. The different shapings can be made, for example, in respect of a different width and spacing and shaping; for example, with the parameter i, the number of individual slots, their width and the spacing by webs between them can vary; by way of example, an embodiment is shown in which the encoding recess 36-1 is in the form of a wide slot, the second encoding recess 36-2 is formed by two individual slots which are separated by a thin web, the third encoding recess 36-3 is formed by three slots, and the fourth encoding recess 36-4 is formed by two slots with a wider web between them. In principle, the angular position of the encoding recess 36-i and accordingly of the encoding lugs 34-i can also be asymmetrical, that is to say not have a 90° subdivision, in order to prevent incorrect engagement.

As the encoding lugs 34-i slide on the boundary 38, tilting can preferably also be avoided in the event of incorrect, brief engagement since incorrect engagement of this kind is not possible on two opposite sides at the same time. This therefore produces a smooth sliding movement in the first sliding plane until encoded engagement with an accurate fit in the respective encoding recesses 36-i and the subsequent axial displacement take place.

Accordingly, the forked contacts 14 on the contact ring 42 are open in the same direction, that is to say in the direction of the relative rotation of the contact blades 30*b*. In principle, different designs of the various contact blades 30*b* and forked contacts 14 are possible; however, according to the invention, it is recognized that this is not necessary in principle since the encoding already takes place the by means of the encoding lugs 34 and encoding recesses 36 and therefore the forked contacts 14 and the base contacts 30 can each be formed as identical parts and therefore in a cost-effective manner.

In the event of relative rotation of the contacts, the contact blades 30*b* therefore enter their forked contacts 14, wherein the contact surfaces 18 of the forked contacts 14 slide on the side surface of the contact blades 30*b*. In this case, the spring limbs 14*a*, 14*b* are accordingly pushed apart from one another, as shown in FIGS. 10 and 11.

Figure 11:
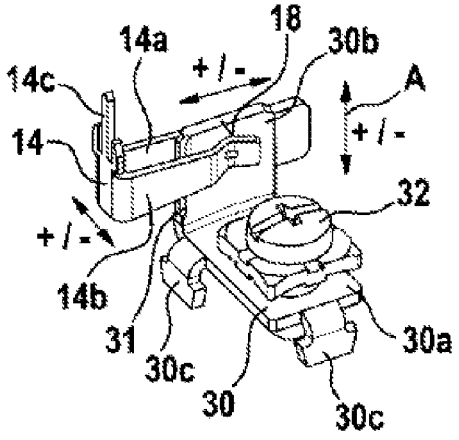

FIG. 11 in particular also shows the mounting tolerances which are indicated by arrows; the position of the contact surfaces 18 on the contact blades 30*b* can vary within the dimensions of the contact blades 30*b*, and therefore the mounting tolerance in the peripheral direction along the contact ring 42 and also in the axial direction A is already given as a result, said mounting tolerance being 4 mm in each direction given corresponding dimensions of the contact blades 30*b* of, for example, 8 mm×8 mm. The tolerance range in the radial direction can be selected to be large since the spring limbs 14*a*, 14*b* correspondingly yield and, given sufficiently long and elastic dimensions, there is accordingly a sufficient mounting tolerance in the radial direction too.

Therefore, the base housing 2*a* and the head housing 3*a* can be formed in a cost-effective manner as an injection-molded part with conventional mounting tolerances and the contacts 14, 30 are inserted in the axial direction A as described, without further readjustments.

The relative rotation of the contacts is terminated by a latching engagement. To this end, ramps 46 which interact with spring means, in this case spring pins 48, are advantageously formed on the inner face of the boundary edge 38, as also shown in FIG. 7 in particular. In the event of relative rotation of the contacts, the spring pins 48 therefore slide onto the ramps 46 so as to form an onset torque by virtue of this friction which increases in the contact-making rotation direction. The design of the ramps 46 is shown in detail in FIG. 9 and, in this case, is illustrated in addition as a contour profile with the contact-making rotation direction K which shows the displacement of the spring pin 48 during locking. The ramp 46 has a first, slightly inclined ramp surface 46*a* on which the spring contact 48 initially slides during the screwing-in movement, and a subsequent second ramp surface 46*b* which drops in the screwing-in direction, and preferably a following surface which is not further relevant. Therefore, the relative rotation for releasing the connection, in the case of which the alarm head 3 is operated counter to the screwing-in direction K, is considerably higher on account of the larger gradient of the second ramp surface 46*b*.

This design therefore results in a screwing-in operation with a first, relatively low screwing-in torque, preferably with identifiable latching when the first ramp surface 46*a* is passed, and as a result clamping in order to secure the bayonet connection 6, and a relatively high release torque on account of the relatively large gradient of the second ramp surface 46*b*. The user therefore receives a haptic sensation.

The invention claimed is:

1. An electrical apparatus (1) comprising:

a base (2) configured to be attached to a substrate (4), a functional head (3) which has at least one electrical or electronic functional device (10), wherein the functional head (3) is attached to the base (2) with a bayonet connection (6), wherein the base (2) has a first contact (14) and the functional head (3) has a second contact (30) which are contact-connected to one another, wherein the bayonet connection (6) is configured to be formed by a relative movement of the functional head (3) in relation to the base (2) in an axial direction (A), and a subsequent relative rotation, characterized in that the first contact (14) and the second contact (30) are configured to be contact-connected to one another by the relative rotation, characterized in that the first or second contact is in the form of a resilient contact and the other contact is in the form of a fixed contact (30*b*) which is to be elastically received in the resilient contact (14), wherein the resilient contact (14) is of resiliently flexible design in a radial plane perpendicular to the axial direction and the fixed contact extends at least partially in the axial direction, and wherein the number of first and second contacts is identical in order to form a plurality of electrical contacts, and characterized in that the resilient contact is in the form of forked contacts (14) with two elastically flexible spring limbs (14*a, b*) for receiving the fixed contact (30*b*) which extend in the axial direction (A) and are in the form of contact blades.

2. The apparatus according to claim 1, characterized in that the electrical or electronic functional device (10) has at least one of a detector and a signal output device.

3. The apparatus according to claim 2, characterized in that the apparatus is a fire alarm (1) or an optical signaling alarm.

4. The apparatus according to claim 1, characterized in that the first contact (14) and the second contact (30) are each inserted into receptacles (16, 28) in the axial direction and are protected against damage in a radial plane perpendicular to the axial direction (A) by protection means.

5. The apparatus according to claim 1, characterized in that the first contact (14) and the second contact (30) are arranged on contact rings (42) with the same radius and are arranged on the contact ring (42) in order to receive the respectively other contact in an identical rotation direction.

6. The apparatus according to claim 1, characterized in that the base (2) has a plurality of first encoding means (36-*i*) and the functional head (3) has a plurality of second encoding means (34-*i*) for defining a relative position of the functional head (3) in relation to the base (2) in order to form the bayonet connection (6), wherein the plurality of first encoding means (36-1, 36-2, 36-3, 36-4) are different and the plurality of second encoding means (34-1, 34-2, 34-3, 34-4) are different for encoding the starting position for forming the bayonet connection (6), wherein one encoding means is in the form of encoding recesses (36) which are formed in a boundary surface (38) and the other encoding means is in the form of encoding lugs (34) which are configured to be inserted into the encoding recesses (36), wherein the encoding lugs (34) are configured to be placed on the boundary surface (38) and are configured to be rotated in a sliding manner in a first sliding plane in order to set the encoded starting position, wherein the encoding lugs (34) are configured to then be pushed in in the axial direction (A) until peripheral slots (40) are reached which adjoin the encoding recesses (36), wherein there is still no engagement of the contact (14, 30) during the axial displacement along the axial direction (A), and wherein the contact-making relative rotation of the alarm head (3) in relation to the base (2) is then permitted, the encoding lugs (34) sliding into the peripheral slots (40) in a second sliding plane, which is different from the first sliding plane, and it being possible for contact to be made between the first contact (14) and the second contact (30) during said contact-making relative rotation.

7. The apparatus according to claim 6, characterized in that the boundary surface (38) is a substantially cylindrical boundary edge (38) which is formed at the axial end.

8. The apparatus according to claim 1, characterized in that the functional head has a head housing (3*a*) which is composed of plastic and the base (2) has a base housing (2*a*) which is composed of plastic, wherein the housings (2*a*, 3*a*) are in the form of injection-molded parts, wherein the contact (14, 30) are inserted into the housings (2*a*, 3*a*) or a contact plate (8), which is placed in the housing, in the axial direction (A).

9. The apparatus according to claim 1, characterized in that the base (2) and the functional head (3) have first friction means (46) and second friction means (48) for forming a frictional connection and a clamping connection, wherein the first friction means (46) and second friction means (48) engage with one another so as to form a resistance torque during the contact-making relative rotation, wherein one friction means are in the form of ramps (46) and the other friction means are in the form of elastic spring means for sliding abutment against the ramps (46), wherein the ramps (46) each have a first ramp surface (46*a*) with a relatively low gradient for forming the resistance torque during the screwing-in process and a downstream second ramp surface (46*b*) for forming a second resistance torque during opening of the bayonet connection (6), and wherein the second ramp surface (46*b*) has a greater gradient than the first ramp surface (46*a*) in order to form a greater resistance torque during opening than during screwing-in.

10. The apparatus according to claim 9, characterized in that the elastic spring means (48) rest against the second ramp surface (46*b*) in a screwed-in state of the bayonet connection (6).

11. The apparatus according to claim 10, characterized in that the ramps (46) are formed on an inner face of a housing edge (38) and the spring means are in the form of spring pins which project in the axial direction, on a floor (22) of the other component.

12. The apparatus according to claim 1, characterized in that the electrical or electronic functional device (10) has at least one of a smoke detector (10) and an optical lighting means.

13. The apparatus according to claim 2, characterized in that the apparatus is an optical signaling alarm for an emergency exit.

14. The apparatus according to claim 1, characterized in that the first contact (14) and the second contact (30) are each inserted into receptacles (16, 28) in the axial direction and are protected against damage in a radial plane perpendicular to the axial direction (A) by contact receptacles (16) and protective ribs (26).

15. An electrical apparatus (1) comprising:

a base (2) configured to be attached to a substrate (4), a functional head (3) which has at least one electrical or electronic functional device (10), wherein the functional head (3) is attached to the base (2) with a bayonet connection (6), wherein the base (2) has a first contact (14) and the functional head (3) has a second contact (30) which are contact-connected to one another, wherein the bayonet connection (6) is configured to be formed by a relative movement of the functional head (3) in relation to the base (2) in an axial direction (A), and a subsequent relative rotation, characterized in that the first contact (14) and the second contact (30) are configured to be contact-connected to one another by the relative rotation, characterized in that the base (2) has a plurality of first encoding means (36-*i*) and the functional head (3) has a plurality of second encoding means (34-*i*) for defining a relative position of the functional head (3) in relation to the base (2) in order to form the bayonet connection (6), wherein the plurality of first encoding means (36-1, 36-2, 36-3, 36-4) are different and the plurality of second encoding means (34-1, 34-2, 34-3, 34-4) are different for encoding the starting position for forming the bayonet connection (6), wherein one encoding means is in the form of encoding recesses (36) which are formed in a boundary surface (38) and the other encoding means is in the form of encoding lugs (34) which are configured to be inserted into the encoding recesses (36), wherein the encoding lugs (34) are configured to be placed on the boundary surface (38) and are configured to be rotated in a sliding manner in a first sliding plane in order to set the encoded starting position, wherein the encoding lugs (34) are configured to then be pushed in in the axial direction (A) until peripheral slots (40) are reached which adjoin the encoding recesses (36), wherein there is still no engagement of the contact (14, 30) during the axial displacement along the axial direction (A), and wherein the contact-making relative rotation of the alarm head (3) in relation to the base (2) is then permitted, the encoding lugs (34) sliding into the peripheral slots (40) in a second sliding plane, which is different from the first sliding plane, and it being possible for contact to be made between the first contact (14) and the second contact (30) during said contact-making relative rotation.

16. The apparatus according to claim 15, characterized in that the boundary surface (38) is a substantially cylindrical boundary edge (38) which is formed at the axial end.

17. An electrical apparatus (1) comprising:

a base (2) configured to be attached to a substrate (4), a functional head (3) which has at least one electrical or electronic functional device (10), wherein the functional head (3) is attached to the base (2) with a bayonet connection (6), wherein the base (2) has a first contact (14) and the functional head (3) has a second contact (30) which are contact-connected to one another, wherein the bayonet connection (6) is configured to be formed by a relative movement of the functional head (3) in relation to the base (2) in an axial direction (A), and a subsequent relative rotation, characterized in that the first contact (14) and the second contact (30) are configured to be contact-connected to one another by the relative rotation, characterized in that the base (2) and the functional head (3) have first friction means (46) and second friction means (48) for forming a frictional connection and a clamping connection, wherein the first friction means (46) and second friction means (48) engage with one another so as to form a resistance torque during the contact-making relative rotation, wherein one friction means are in the form of ramps (46) and the other friction means are in the form of elastic spring means for sliding abutment against the ramps (46), wherein the ramps (46) each have a first ramp surface (46*a*) with a relatively low gradient for forming the resistance torque during the screwing-in process and a downstream second ramp surface (46*b*) for forming a second resistance torque during opening of the bayonet connection (6), and wherein the second ramp surface (46*b*) has a greater gradient than the first ramp surface (46*a*) in order to form a greater resistance torque during opening than during screwing-in.

18. The apparatus according to claim 17, characterized in that the elastic spring means (48) rest against the second ramp surface (46*b*) in a screwed-in state of the bayonet connection (6).

19. The apparatus according to claim 18, characterized in that the ramps (46) are formed on an inner face of a housing edge (38) and the spring means are in the form of spring pins which project in the axial direction, on a floor (22) of the other component.

* * * * *